US006270250B1

(12) United States Patent
Song

(10) Patent No.: US 6,270,250 B1
(45) Date of Patent: Aug. 7, 2001

(54) WATCH HAVING AN OPENING

(76) Inventor: Byung-Jun Song, 1209-1404, Jukong Apt., Chulsan-dong, Kwangmyung-city, Kyungki-do (KR)

( * ) Notice: Subject to any disclaimer, the term of this patent is extended or adjusted under 35 U.S.C. 154(b) by 0 days.

(21) Appl. No.: 09/397,757

(22) Filed: Sep. 16, 1999

(51) Int. Cl.[7] ..... G04B 1/00; A44C 5/00
(52) U.S. Cl. ..... 368/281; 368/204
(58) Field of Search ..... 368/281, 282, 368/203–205, 223–235

(56) References Cited

U.S. PATENT DOCUMENTS 4,473,304 * 9/1984 Ketner ..... 368/281
4,525,077 * 6/1985 Ketner ..... 368/77

* cited by examiner

*Primary Examiner*—Bernard Roskoski
(74) *Attorney, Agent, or Firm*—F. Chau & Associates, LLP

(57) ABSTRACT

The present invention relates to a watch having an opening formed through the watch body. The opening can be of various shapes to facilitate a variety of designs and serve to ventilate the watch-wearing area of a human body. The watch with the opening may include shafts of hour and minute pointers, which separately rotate and are substantially coaxial with the watch opening.

19 Claims, 8 Drawing Sheets

WATCH HAVING AN OPENING

FIELD OF THE INVENTION

The present invention relates to a watch, more particularly to a watch having an opening or a bore through its body.

BACKGROUND OF THE INVENTION

A watch is predominately used as a timepiece. Many users wear a watch as a jewel or a decorative fashion item as well. Thus, a watch keeps time and appears in various shapes and forms. The movement mechanism of the watch to keep time is well known. Gears which move the hour and minute hands of an analog watch are wind by stored energy, either from a battery or from manual cranking. Basic shapes of conventional watches are shown in FIGS. 1 and 2.

FIG. 1 shows an analog watch, and FIG. 2 shows a conventional digital watch. In a digital watch, the only form of stored energy is the battery.

As shown in the figures, a watch typically has a watch body (100) and a watch face (110). The watch body (100) contains mechanism for moving the hands to show time. The watch face (110) can be an analog display panel or a digital display. A problem with a conventional watch is that when it is worn on human wrist for a long time, sweat develops underneath the watch body from lack of ventilation, causing discomfort and dirt buildup on the underside of the watch.

Therefore, a need exists for a watch having means for ventilation and one which provides a unique physical shape as well.

SUMMARY OF THE INVENTION

It is an object of the present invention to provide a watch opening through a watch body, affording ventilation and reducing sweating at the area where the watch is worn.

It is another object of the present invention to provide a watch opening formed through a watch body, and having a mechanism for operating the watch as a timepiece while facilitating designs of various shapes.

A watch having a watch opening of the present invention may have display units to show time, day, month, and/or weekday by using, for example, liquid crystal display (LCD). In an analog watch, a watch opening may be formed in separately rotating round plates disposed in a watch body, wherein the round plates are substantially coaxial and have hour and minute pointers thereon. A watch opening of the present invention may also be formed in coaxial shafts of hour and minute pointers of a watch.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DESCRIPTION OF PREFERRED EMBODIMENTS

Figure 1:
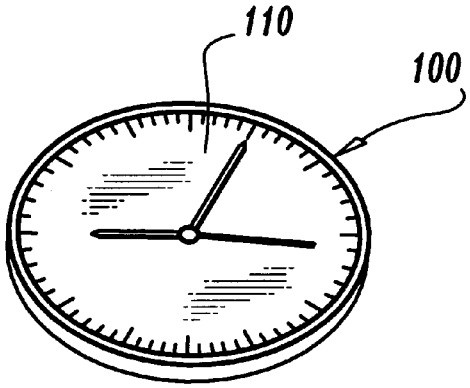
FIG. 1 (Prior Art)
FIG. 1 is a perspective view of a conventional analog watch.
Figure 2:
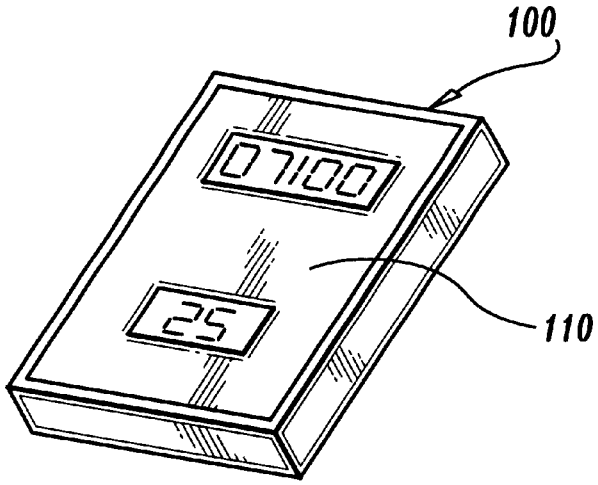
FIG. 2 (Prior Art)
FIG. 2 is a perspective view of a conventional digital watch.
Figure 3:
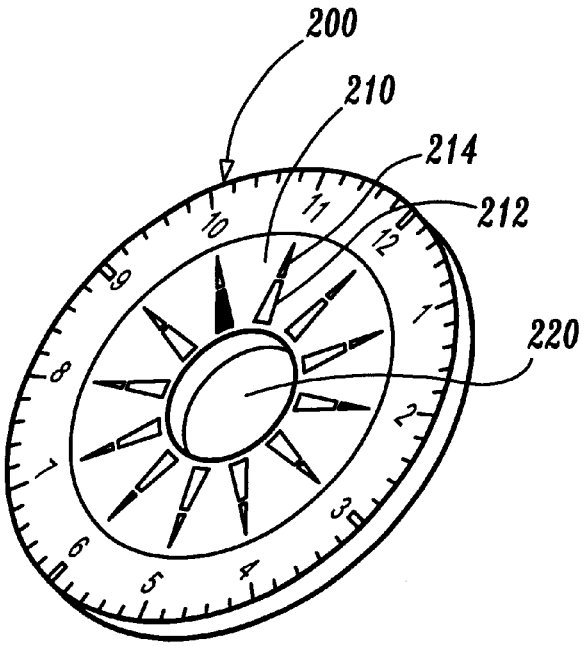
FIG. 3. is a perspective view of an embodiment of a watch having an opening according to the present invention.
Figure 7:
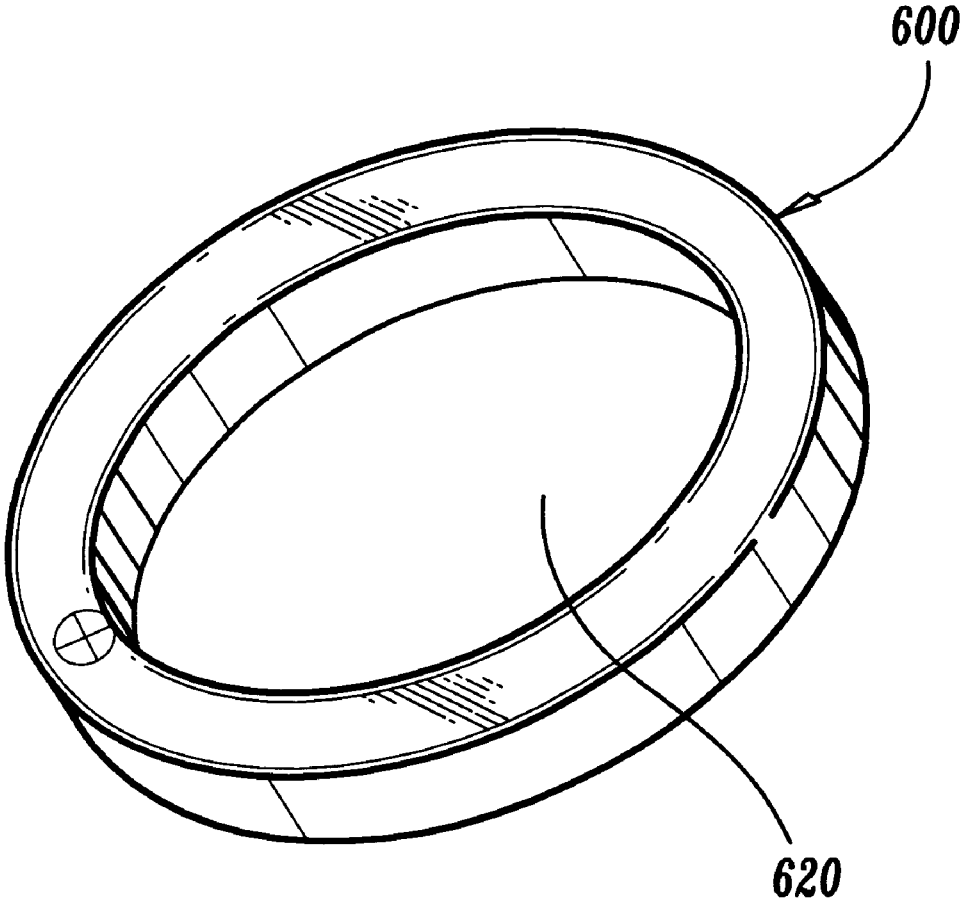
FIG. 7 is a perspective view of an embodiment of a battery usable for a watch according to the present invention.

FIG. 3 is a perspective view of a watch having a preferred embodiment of a watch opening according to the present invention. As shown in the figure, a watch opening (220) is formed through a watch body (200). The watch opening (220) is preferably of a round shape. The watch body (200) has a watch face (210) for displaying time using, for example, liquid crystal display (LCD). The watch face (210) has hour pointers (212) disposed on a circumference and minute pointers (214) disposed on another circumference. The circumferences have different diameters and are centered on the center of the watch opening (220). The hour and minute pointers (212 and 214) indicate predetermined time intervals. An hour pointer (212) and a minute pointer (214) of the watch surface (210) can indicate a specific time by activation of LCDs of the hour and minute pointers corresponding to present time. The hour and minute pointers (212 and 214) are activated or turned on in sequence as in the clockwise rotation of the hour and minute hands of a watch during normal operation. For example, the watch in FIG. 3 shows 10 minutes after 10 o'clock. The mechanism for activating the LCDs in accordance with the travel of time is preferably by digital cranking, comprising an oscillator and switching crank to time on off the LCDs. Such cranking can be found in commonly available digital watches. The mechanism is preferably powered by a battery as shown in FIG. 7, which will be further described below.

Figure 4:
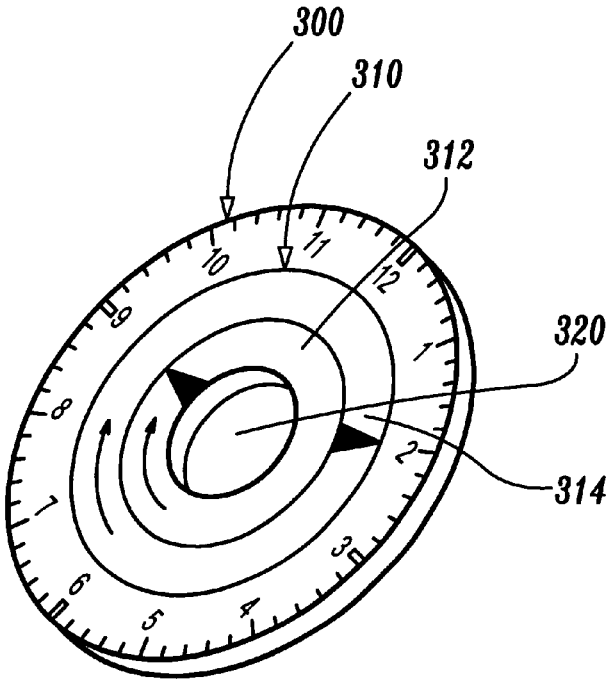
FIG. 4 is a perspective view of another embodiment of a watch according to the present invention.

FIG. 4 shows another embodiment of a watch having a watch opening through its body. A watch body (300) has a watch opening (320) of predetermined size and shape. A watch face (310) has an hour pointer and a minute pointer, which are disposed on two concentric ring-type plates (312 and 314), respectively. The two round plates (312 and 314) rotate separately, and the hour and minute pointers thereon indicate every hour and minute in sequence, respectively. That is, the round plates (312 and 314) on the watch face (310) separately rotate in the direction of the arrows shown in the figure, thereby the hour and minute pointers show every moment. The watch in FIG. 4, for example, shows 10 minutes after 9 o'clock. The mechanism for movement of the watch according to this embodiment of the invention is similar to mechanism found in commonly available analog watches, such as a quartz crystal and gearing means to move the hour and minute hands.

In the analog watch as shown in FIG. 4, gearing in the watch body (300) rotates the round plates (312 and 314) with the hour and minute pointers thereon. The round plates (312 and 314) respectively have their own shafts (not shown). The shafts are substantially coaxial with the watch opening (320). It can be seen that the watch shown in FIG. 4 is distinctive in shape and form from a conventional watch and has an opening through its body. Operation of the watch is substantially similar to that of a conventional watch.

Figure 5:
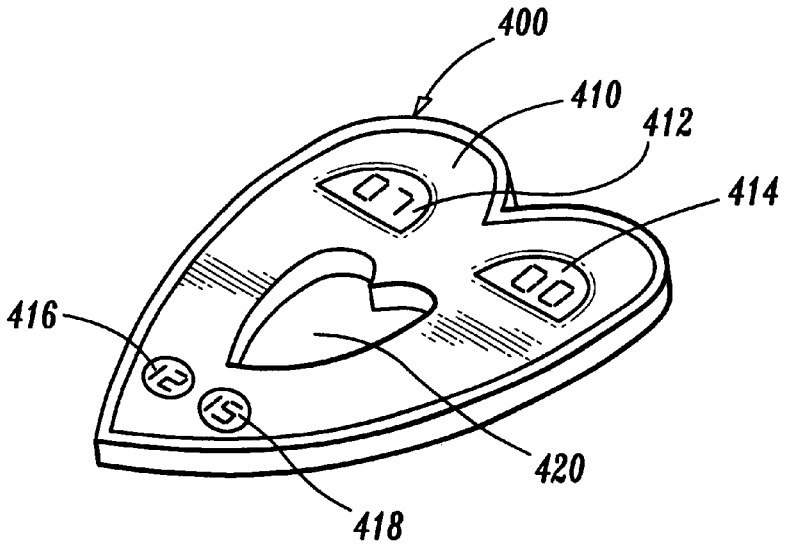
FIG. 5 is a perspective view of an embodiment of a digital watch opening having a heart shape according to the present invention.

FIG. 5 shows another embodiment of a watch according to the present invention. A watch opening (420) is formed through watch body (400). The watch body (400) and the opening (420) are of a heart shape. A watch face (410) of the watch body (400) has an hour display unit (412), a minute display unit (414), a month display unit (416), and a day display unit (418). LCD is preferably used. Time would be readily recognized from the display units (412 to 418) showing the numbers of hour, minute, month, and day.

Figure 6:
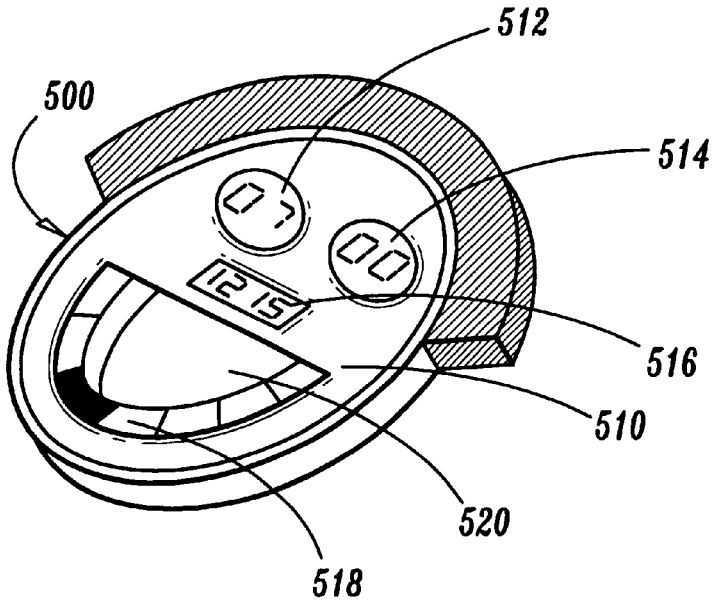
FIG. 6 is a perspective view of an embodiment of a watch opening having a half circle shape according to the present invention.

FIG. 6 shows another embodiment of a watch opening according to the present invention. As shown, a watch opening (520) formed in a watch body (500) has a half-circle shape, and an overall exterior of the watch resembles a smiling face. A watch face (510) has an hour display unit (512), a minute display unit (514), a month and day display unit (516), and a week day display unit (518). Again, LCD is used as a display. But, it is understood that any equivalent display, such as LEDs, can be used. In this embodiment, time is also readily recognized from the display of hour, minute, month, and day on the display units (512 to 516), respectively. The day of the week can also be readily recognized from activation of the corresponding LCD on the weekday display unit (518).

FIG. 7 shows a preferred embodiment of a ring-type battery (600) which is preferably used for the watches of the present invention. For example, the ring-type battery (600) is installed within the watch bodies (200, 300, 500) having the watch openings (220, 320, 520), as shown in FIGS. 3, 4, and 6, respectively . The ring-type battery (600) has an opening (620) to match with the opening. The top and bottom of the battery (600) are the positive and negative terminals of the battery. It would be also readily understood that a battery for a watch having a watch opening may have one of various shapes depending on a shape of the watch opening. For example, a heart shaped battery may be used for the watch as shown in FIG. 5.

Figure 8:
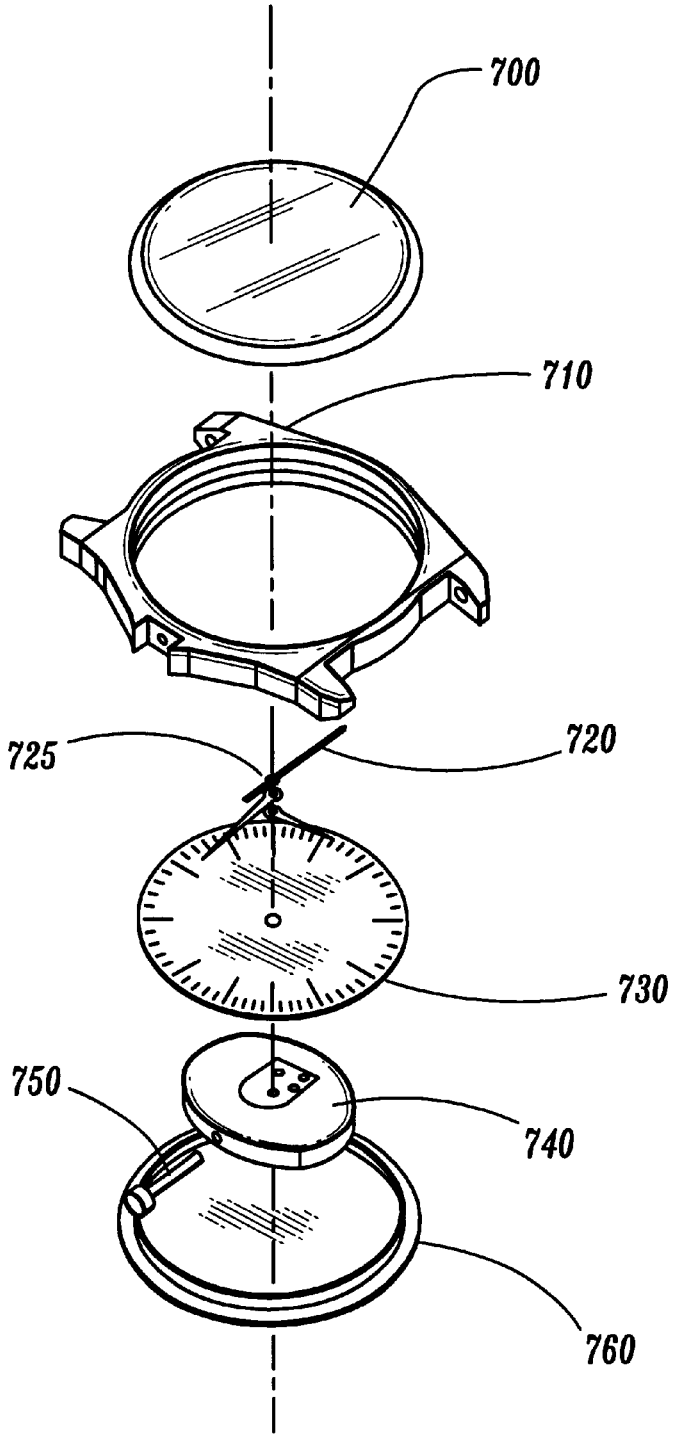
FIG. 8 (Prior Art)
FIG. 8 is a exploded view of a prior art watch.

FIG. 8 shows a conventional analog watch arrangement without an opening in the center. The cover (700) is disposed upon the top of the watch housing (710). The hour and minute hands (720) are situated in and pivots from the center of the watch face (730). Pivot pin (725) of hour and minute hands goes through the watch face (730) and engages the movement mechanism (740). Winder (750) also engages the movement mechanism for manual movement of the hands. The movement mechanism includes gears which move concomitantly with the hour and minute hands. The gears are moved by battery (not shown). The bottom cover (760) encloses the watch and is attached to the bottom of the watch housing (710).

Figure 9:
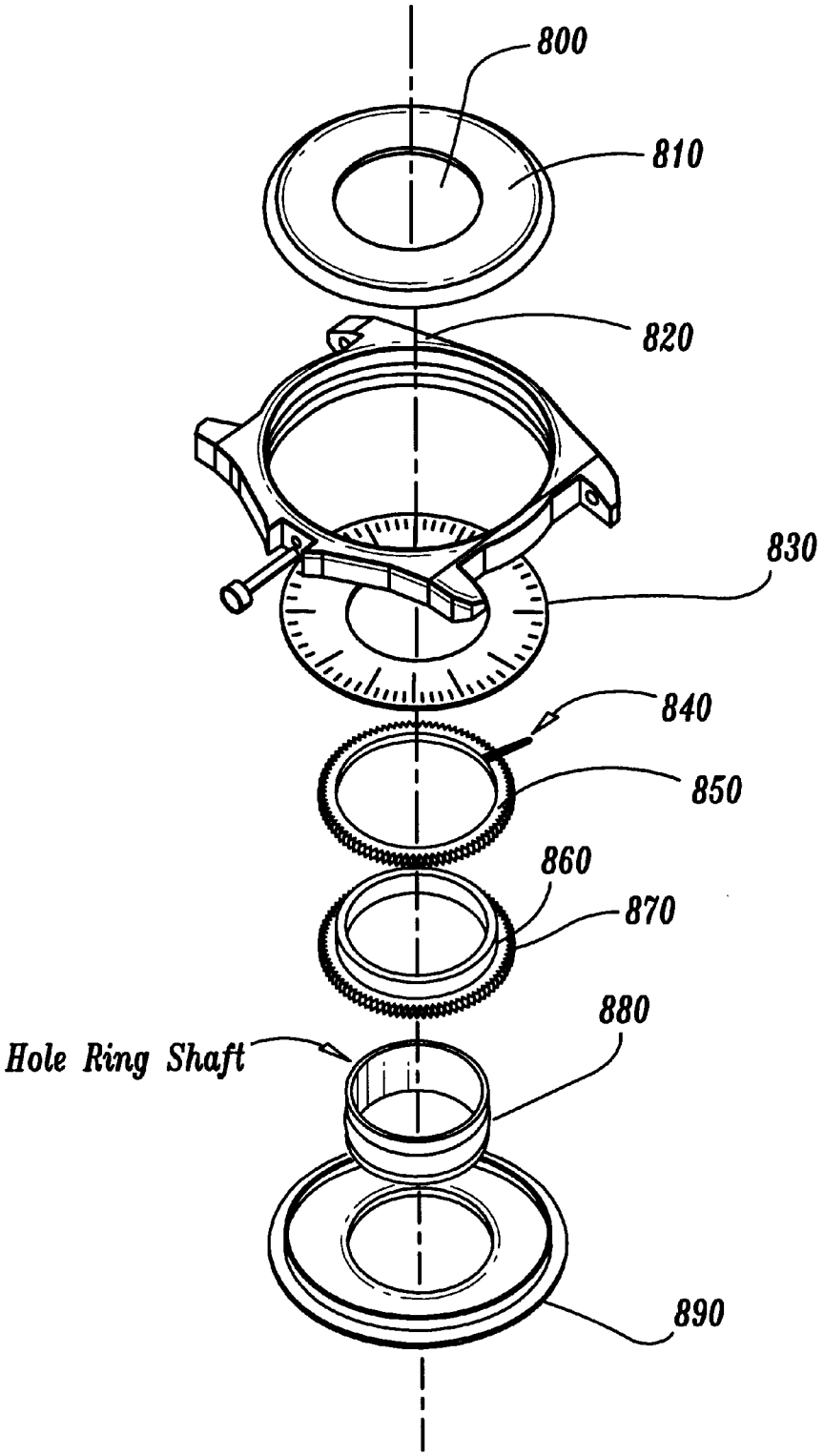
FIG. 9 is exploded view of one embodiment of the watch of the present invention.

FIG. 9 depicts a preferred embodiment of a watch according to the present invention. A cover (810) has opening (800) for covering watch face (850) having the same shape and equally dimensioned surface area and opening as the cover (810). The cover (810) is secured on the top of the housing (820). The minute gear (850) and needle (840) and the hour gear (860) and needle (870) may either stack on top of one another or one gear may lie inside another gear. Shaft (880) is concentrically disposed inside of minute gear (850) and hour gear (860). The bottom housing with an opening (890) encases the watch by attaching to the bottom of the watch top housing (820) and shaft (880). The top and bottom housings and the shaft form a closed unit and act to shield the gears, needles and movement mechanism.

Figure 10:
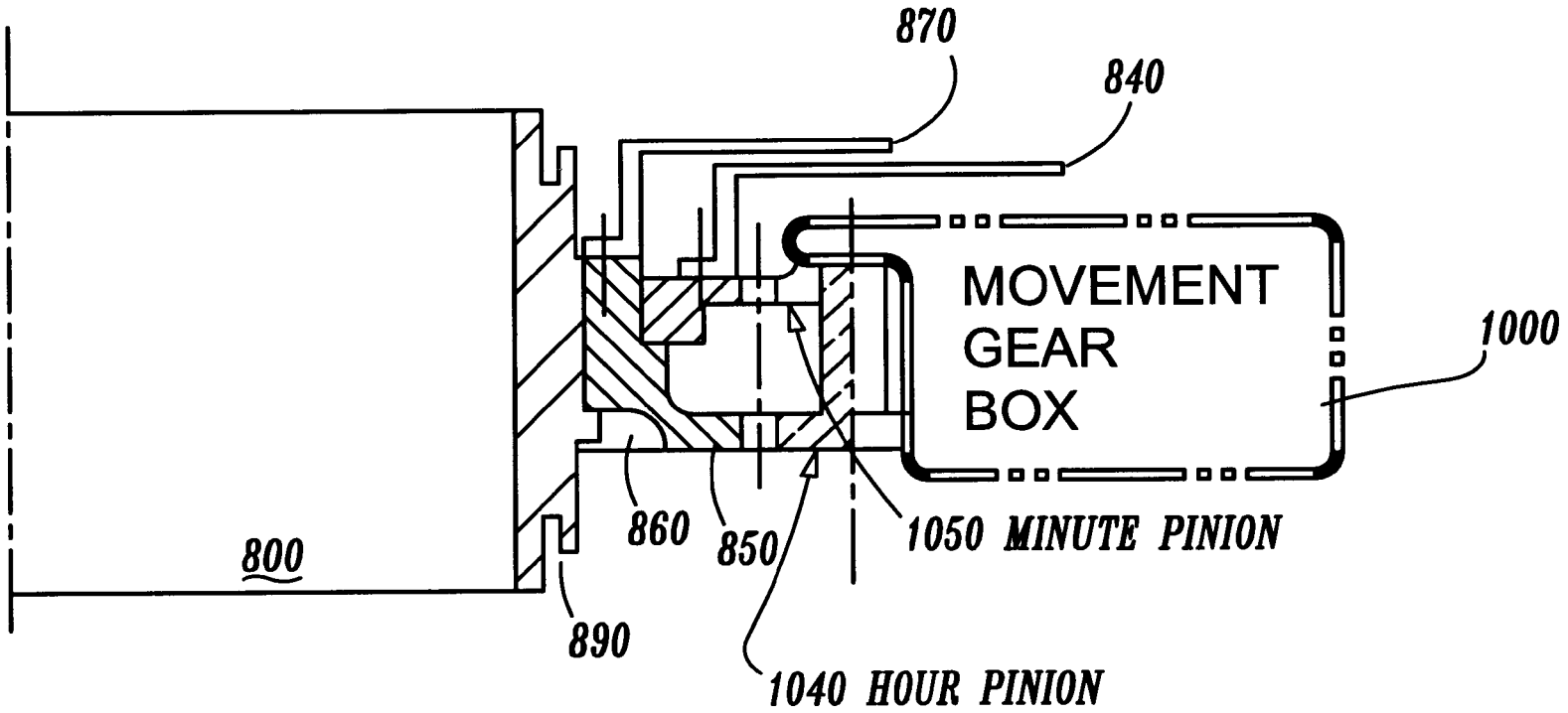
FIG. 10 is a cross-section view of the movement mechanism of an embodiment of the watch according to the present invention.

FIG. 10 shows a cross-section view depicting the movement mechanism (910) engaged to hour and minute gears for causing movement of the hour needle (870) and minute needle (840). Movement gear box (1000) causes movement mechanism (910) to move by stored energy such as a battery. Movement mechanism (910) includes hour pinion (1040) meshed with hour gear (860) and minute pinion (1050) meshed with minute gear (850), thereby moving hour needle (870) and minute needle (840).

Figure 11:
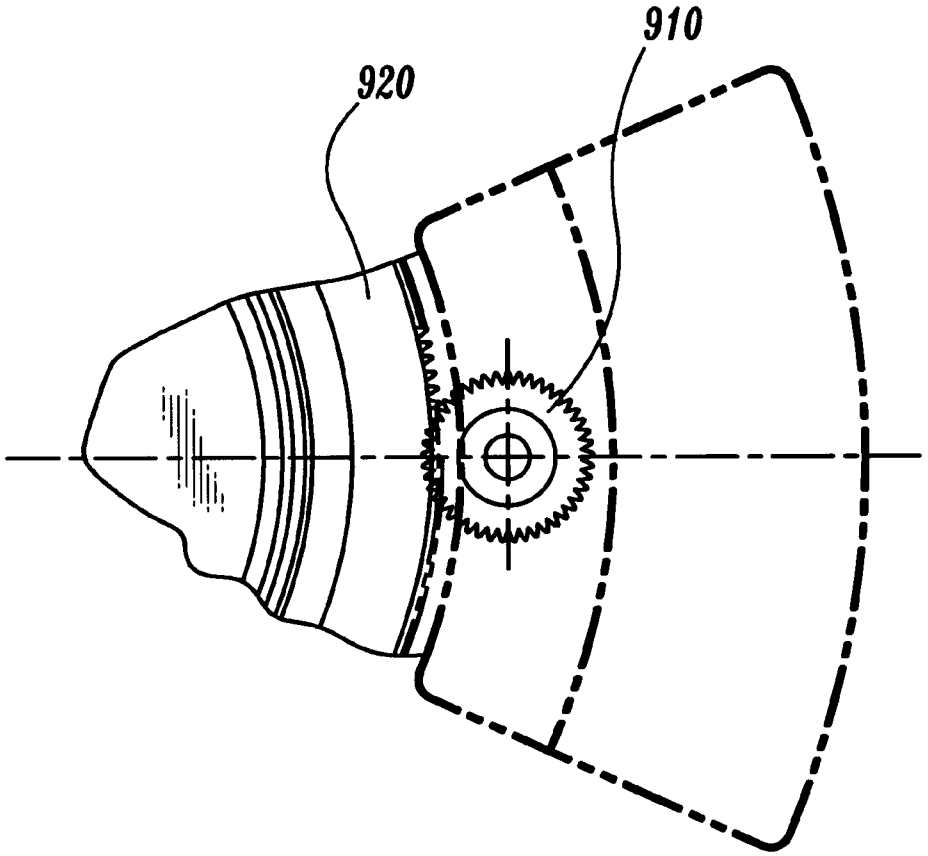
FIG. 11 is a top view of the movement mechanism and the watch of FIG. 10.

FIG. 11 shows a top view of movement mechanism (910) and its engagement with hour gear (860).

Advantageously, a watch opening of the present invention provides ventilating effects, which can lessen the sweating at the area where a watch is worn, providing comfort for wearing the watch for an extended period. Further various appealing shapes having watch openings is made possible by the present invention.

What is claimed is:

1. A watch comprising:

a watch body including a watch face, the watch body and the watch face including an opening therethrough, wherein said watch face includes hour and minute indicators disposed thereon; and a battery having an opening therethrough installed within the watch body wherein said openings of the battery, the watch body and the watch face are in alignment.

2. The watch as in claim 1, wherein the hour and minutes indicators are liquid crystal displays (LCD).

3. The watch as in claim 1, wherein the hour and minute indicators are separately rotating rings.

4. The watch as in claim 3, further including positions on said rings for indicating time.

5. The watch as in claim 1, wherein the watch body and the watch face are ring-shaped.

6. The watch as in claim 1, wherein the opening is shaped substantially coaxial with the peripheral shape of the watch body.

7. The watch as in claim 6, wherein the opening has a heart shape.

8. The watch as in claim 1, wherein the battery includes an opening conforming to a shape of the opening formed through the watch body and the watch face.

9. The watch as in claim 7, wherein the battery has a heart shape.

10. The watch as in claim 1, wherein the body of the watch has at least two separately rotating round plates for showing time, each of the at least two round plates having an opening which is substantially coaxial with the opening through said watch body.

11. A watch comprising:

a watch body including a cover for covering a watch face, the watch face including hour and minute indicators formed thereon;

a top housing for securing the cover thereto;

a shaft for connecting the top housing to a bottom housing; and a battery installed within said watch body, wherein said cover, the watch face, the top housing, the shaft, the bottom housing and the battery each include an opening formed therethrough, and wherein each of said openings are in alignment.

12. The watch as in claim 11, wherein the hour and minutes indicators are liquid crystal displays (LCD).

13. The watch as in claim 11, wherein the hour and minute indicators are separately rotating rings.

14. The watch as in claim 13, further including positions on said rings for indicating time.

15. The watch as in claim 9, wherein the opening is shaped substantially coaxial with the peripheral shape of the watch body.

16. The watch as in claim 15, wherein the opening has a heart shape.

17. The watch as in claim 11, wherein the body of the watch has at least two separately rotating round plates for showing time, each of the at least two round plates having an opening which is substantially coaxial with the opening through said watch body.

18. The watch as in claim 16, wherein the battery has a heart shape.

19. The watch as in claim 5, wherein the battery is ring-shaped.

* * * * *